US008226218B2

(12) United States Patent
Mizoguchi et al.

(10) Patent No.: US 8,226,218 B2
(45) Date of Patent: Jul. 24, 2012

(54) PASSAGE COMPOSITE, AN INK JET HEAD AND A PRINTER

(75) Inventors: Yuji Mizoguchi, Kani (JP); Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1131 days.

(21) Appl. No.: 12/033,879

(22) Filed: Feb. 19, 2008

(65) Prior Publication Data

US 2008/0198209 A1 Aug. 21, 2008

(30) Foreign Application Priority Data

Feb. 19, 2007 (JP) ..... 2007-038366

(51) Int. Cl.
*B41J 2/175* (2006.01)

(52) U.S. Cl. ..... 347/85; 347/65; 347/92

(58) Field of Classification Search ..... 347/40, 347/43, 58, 59, 68, 70–72, 85
See application file for complete search history.

(56) References Cited

U.S. PATENT DOCUMENTS

| | | | | |
|---|---|---|---|---|
| 7,303,271 | B2 | 12/2007 | Shimizu et al. | |
| 7,384,133 | B2 | 6/2008 | Ishizawa et al. | |
| 2007/0216738 | A1* | 9/2007 | Shimizu et al. | 347/85 |
| 2007/0273730 | A1* | 11/2007 | Akahane | 347/65 |
| 2008/0239028 | A1* | 10/2008 | Umeda | 347/85 |
| 2008/0239040 | A1* | 10/2008 | Umeda | 347/92 |

FOREIGN PATENT DOCUMENTS

| | | | |
|---|---|---|---|
| JP | 2005-059322 | A | 3/2005 |
| JP | 2005-145045 | A | 6/2005 |

OTHER PUBLICATIONS

Japanese Patent Office, Notice of Reasons for Rejection for Japanese Patent Application No. 2007-038366, mailed Jan. 6, 2009.

* cited by examiner

*Primary Examiner* — Ellen Kim
(74) *Attorney, Agent, or Firm* — Baker Botts L.L.P.

(57) ABSTRACT

A printer has an inkjet head, which has a passage composite. The passage composite has a main body, having a surface and a projection portion that extends outward from the surface. The projection portion has an opening formed through it, and the projection portion also has an end, and an edge opposite the end. The main body also has at least one rib positioned outside the projection portion. The at least one rib extends away from the surface, and is separated by a predetermined nonzero distance from the edge of the projection portion.

15 Claims, 10 Drawing Sheets

PASSAGE COMPOSITE, AN INK JET HEAD AND A PRINTER

CROSS-REFERENCE TO RELATED APPLICATION

The present application claims priority from Japanese Patent Application No. 2007-038366, which was filed on Feb. 19, 2007, the disclosure of which is herein incorporated in its entirety by reference.

BACKGROUND OF THE INVENTION

1. Field of the Invention

The present invention relates to a passage composite, and the use of a passage composite in an ink jet head and in a printer.

2. Description of the Related Art

Known ink jet heads for ejecting ink from nozzles to a sheet of paper each include a passage unit having a plurality of individual ink passages extending to nozzles arranged on the bottom surface of the ink jet head, and a reservoir unit that temporarily stores ink and supplies the ink to the passage unit.

In the known ink jet heads, the reservoir unit has a laminate structure including a passage block and three metal plates. The passage block is long in the main scanning direction and is made of a thermoplastic resin. Each metal plate has a rectangular planar surface that is long in the main scanning direction. The reservoir unit has an ink passage therein. The passage block has a loop projection and defines at least part of a passage opening closed by a film. The passage block has ribs projecting perpendicular to the first surface. Some of the ribs are connected to the outer surface of the loop projection.

SUMMARY OF THE INVENTION

Accordingly, it is an object of the present invention to provide a passage composite in which an operation of arranging a film can easily and efficiently be performed and which ensures improvement of yield. In an embodiment of the invention, a passage composite comprises a main body comprising, the main body comprising a particular surface, a passage projection portion extending away from the particular surface and comprising a particular end, an edge opposite the particular end, and an opening formed therethrough, and at least one rib positioned outside the passage projection portion, and extending away from the particular surface, wherein at least a portion of the at least one rib is positioned a predetermined nonzero distance from the edge of the passage projection portion.

In another embodiment of the invention, an ink jet head comprises a passage composite. The passage composite comprises a main body, which comprises a particular surface, a passage projection portion extending away from the particular surface and comprising a particular end, an edge opposite the particular end, and an opening formed therethrough, and at least one rib positioned outside the passage projection portion, and extending away from the particular surface, wherein at least a portion of the at least one rib is positioned a predetermined nonzero distance from the edge of the passage projection portion.

In yet another embodiment of the invention, a printer comprises an ink cartridge configured to supply ink, and an ink jet head comprising a passage composite, the passage composite comprising a main body. The main body comprises a particular surface, a passage projection portion extending away from the particular surface and comprising a particular end, an edge opposite the particular end, and an opening formed therethrough, and at least one rib positioned outside the passage projection portion, and extending away from the particular surface, wherein at least a portion of the at least one rib is positioned a predetermined nonzero distance from the edge of the passage projection portion.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DESCRIPTION OF THE PREFERRED EMBODIMENTS

Embodiments of the present invention, and their features and advantages, are understood by referring to FIGS. 1-10B, with like numerals being used for like corresponding parts in the various drawings.

Figure 1:
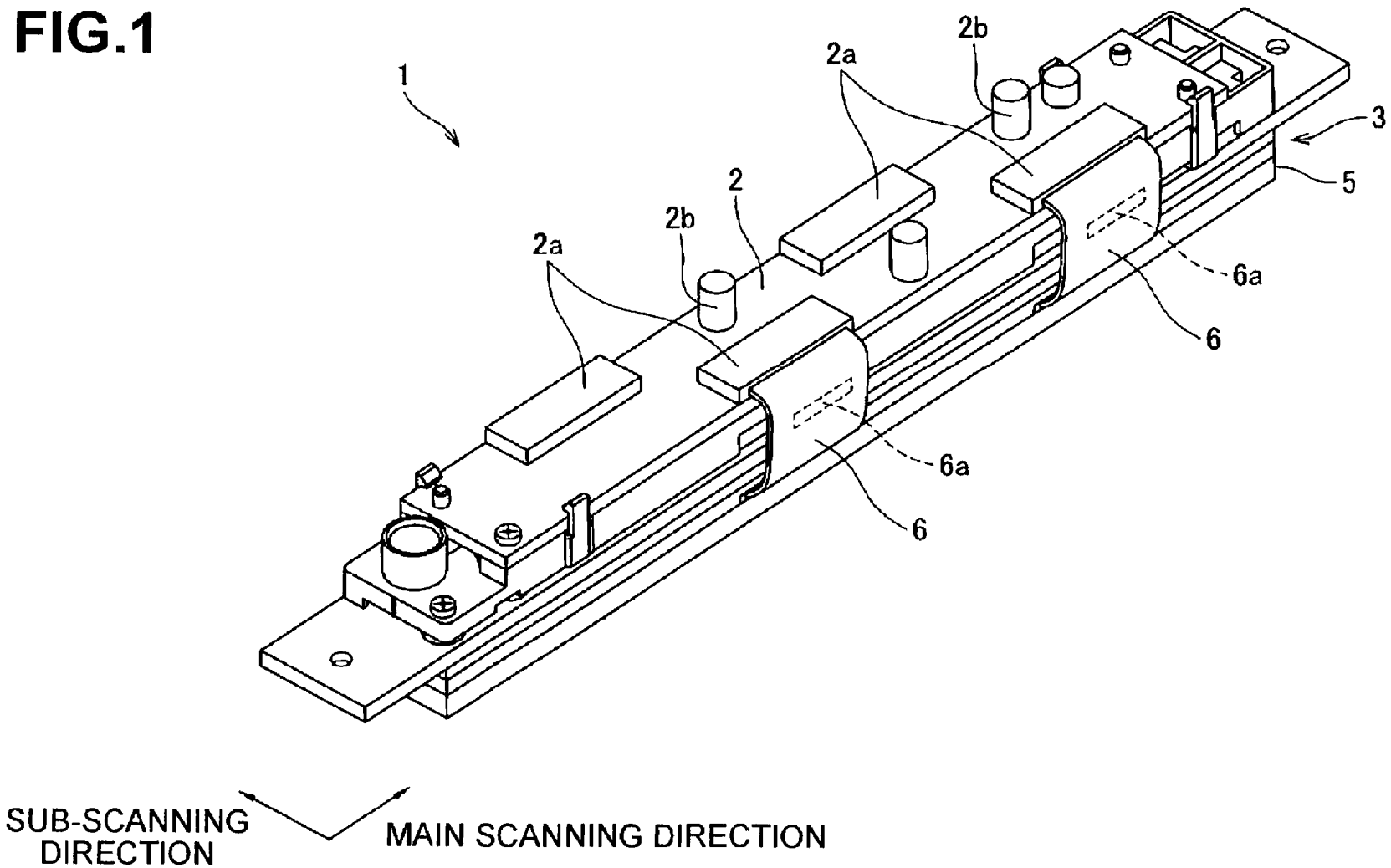
FIG. 1 is a perspective view of an ink jet head according to an embodiment of the invention.
Figure 9:
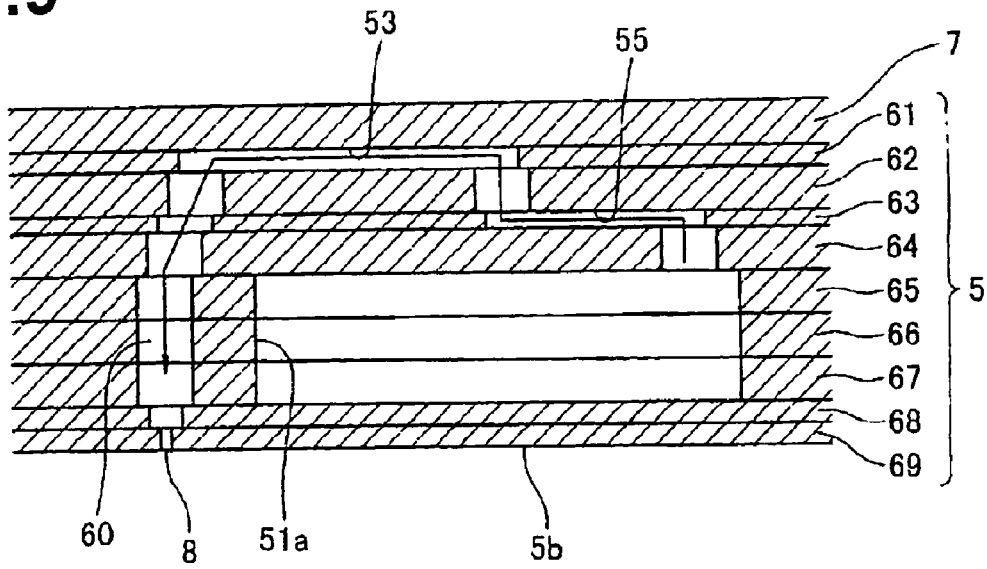
FIG. 9 is a partially cross-sectional view taken along the line IX-IX in FIG. 8.

FIG. 1 may be an external perspective view of an ink jet head according to an embodiment. Referring to FIG. 1, an ink jet head 1, may have a substantially rectangular shape, and the longer sides of ink jet head 1 may extend in the main scanning direction. Ink jet head 1 may include, in order from the bottom, a passage unit 5, a reservoir unit 3, and a substrate 2. Referring to FIG. 9, passage unit 5 may include a plurality of individual ink passages 60, which may be in fluid communication with a plurality of nozzles 8. Referring back to FIG. 1, reservoir unit 3 temporarily may store ink and may supply the ink to passage unit 5. The substrate 2 may be mounted with electronic components, such as connectors 2*a* and capacitors 2*b*. With reference to the following description and the associated drawings, one side of the ink jet head 1, e.g., the side in which the passage unit 5 may be arranged, will be interchangeably referred to as a "lower side." Another side, e.g., the side in which the substrate 2 may be arranged will be interchangeably referred to as an "upper side."

Figure 2:
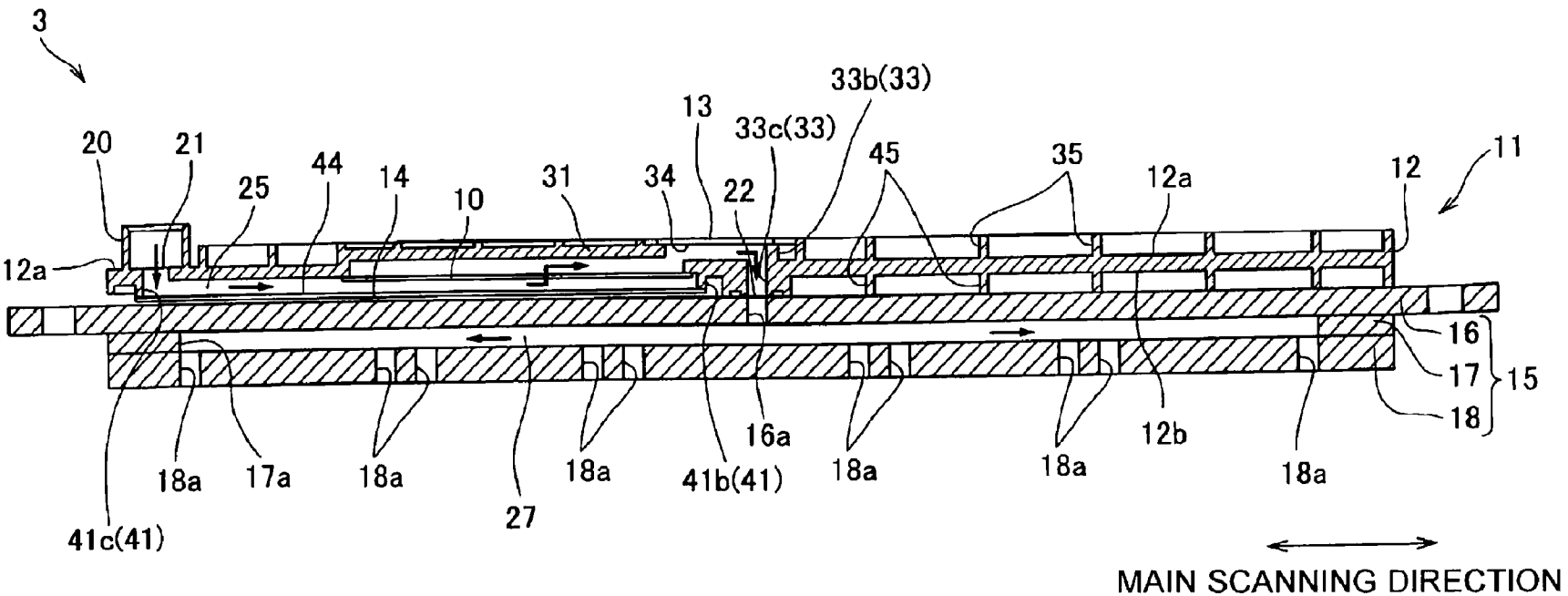
FIG. 2 is a longitudinal sectional view of a reservoir unit shown in FIG. 1 according to an embodiment of the invention.
Figure 7:
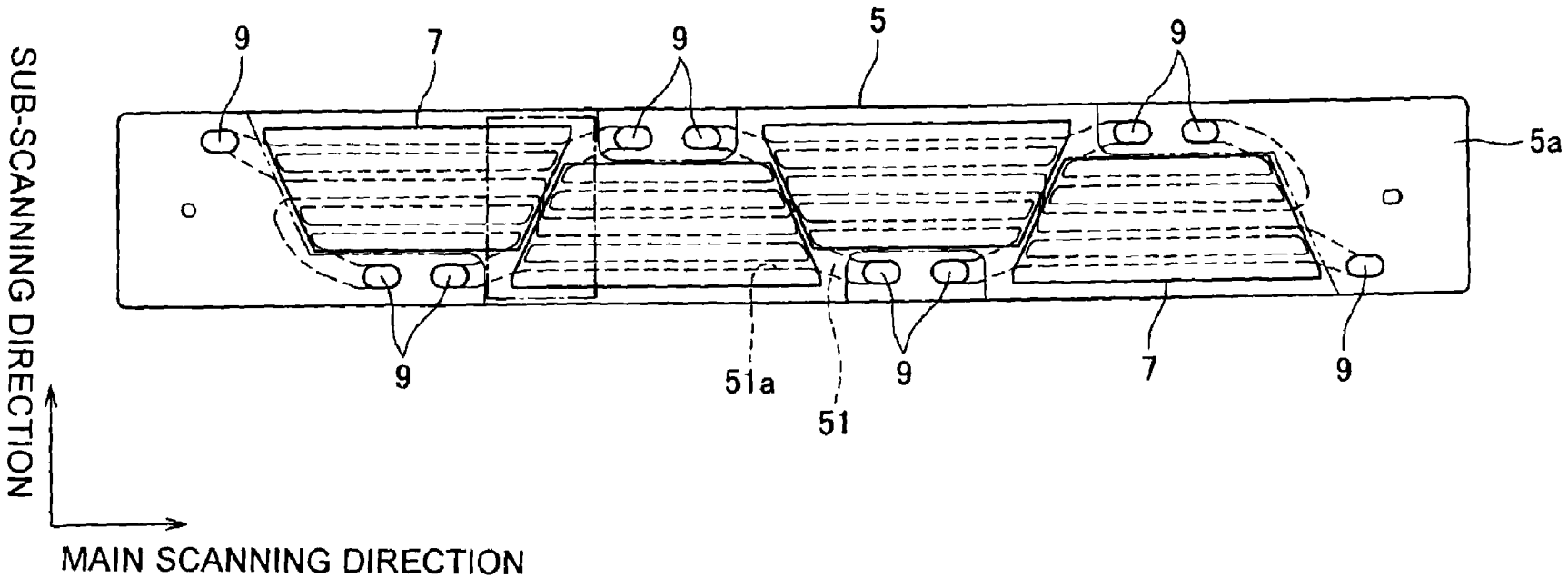
FIG. 7 is a plan view of a passage unit shown in FIG. 1, according to an embodiment of the invention.

Referring now to FIG. 7, a plurality of, e.g., four, actuator units 7 may be fixed to an upper surface 5*a* of the passage unit 5. Flexible printed circuits (FPCs) 6, which may function as interconnecting members attached to the respective actuator units 7, may extend from between the passage unit 5 and the reservoir unit 3, in an upward direction along the side surfaces of the reservoir unit 3. FPCs 6 may be connected to the respective connectors 2*a* on the substrate 2. Each FPC 6 may be mounted with a driver IC 6*a*. Driver IC 6*a* may be positioned between the corresponding actuator unit 7 and the substrate 2. In other words, each FPC 6 may be electrically connected to both of the substrate 2 and the driver IC 6*a*. Accordingly, the FPC 6 may transmit an image signal output from the substrate 2 to the corresponding driver IC 6*a*, and may supply a drive signal output from the driver IC 6*a* to the actuator unit 7. Referring to FIG. 2, the the ink jet head is enlarged in the vertical direction, and passages which may not appear in the plane shown in the sectional view of FIG. 2, are shown in FIG. 2.

Reservoir unit 3 may have a laminate structure containing the upper reservoir block 11 extending in the main scanning direction, and a plurality, e.g., three, plates 16, 17, and 18 extending in the main scanning direction. The plates 16 to 18 may be plates made of metal, e.g., stainless steel. The laminated plates 16 to 18 may constitute a lower reservoir block 15 of the reservoir unit 3.

The upper reservoir block 11 may be made of a thermoplastic resin, e.g., polyacetal or polypropylene. Upper reservoir block 11 may includes the main body 12 extending in the main scanning direction, and films 13 and 14, which may be welded to the main body 12. Upper reservoir block 11 may have an inlet port 21, an outlet port 22, and an upper reservoir passage 25. Outlet port 22 may be arranged substantially in the center of the main body 12 in the lengthwise direction thereof The inlet port 21 may be in fluid communication with a space over the main body 12. The outlet port 22 may be in fluid communication with a space under the main body 12. The upper reservoir passage 25 may connect the inlet port 21 to the outlet port 22. In other words, the upper reservoir passage 25 may be arranged between the center and one end of the upper reservoir block 11 in the lengthwise direction thereof.

A cylindrical joint 20 surrounding the inlet port 21 and extending upward may be arranged on an upper reference surface 12*a*, e.g., a first surface of the main body 12, and may face upward. The joint 20 may be connected to a connecting member coupled to one end of an ink supply tube (not shown) connected to an ink tank (not shown). With the above-described arrangement, ink may be supplied from the ink tank to the upper reservoir passage 25 via the joint 20.

Part of the main body 12 may serve as the wall surface of the upper reservoir passage 25, and may constitute a protuberance 31 raised upward from the upper reference surface 12*a*. A side wall 33 of the protuberance 31 may be a loop projection projecting upward from the upper reference surface 12*a*. More specifically, the protuberance 31 may be arranged between the outlet port 22 and the vicinity of the center of the upper reservoir passage 25. Proturberance 31 may extend in the lengthwise direction of the upper reservoir block 11, e.g., the main scanning direction.

Figure 3A:
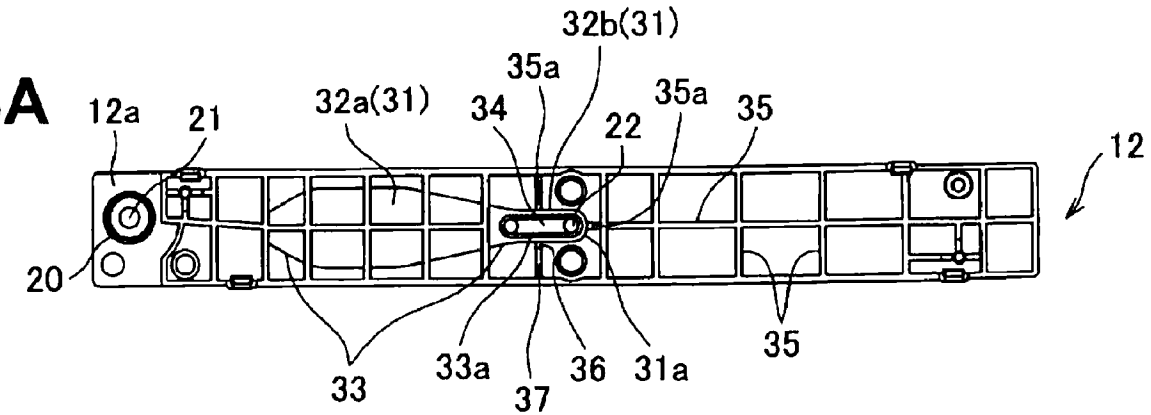
FIG. 3A is a top view of a main body of an upper reservoir block shown in FIG. 2, according to an embodiment of the present invention.
Figure 4:
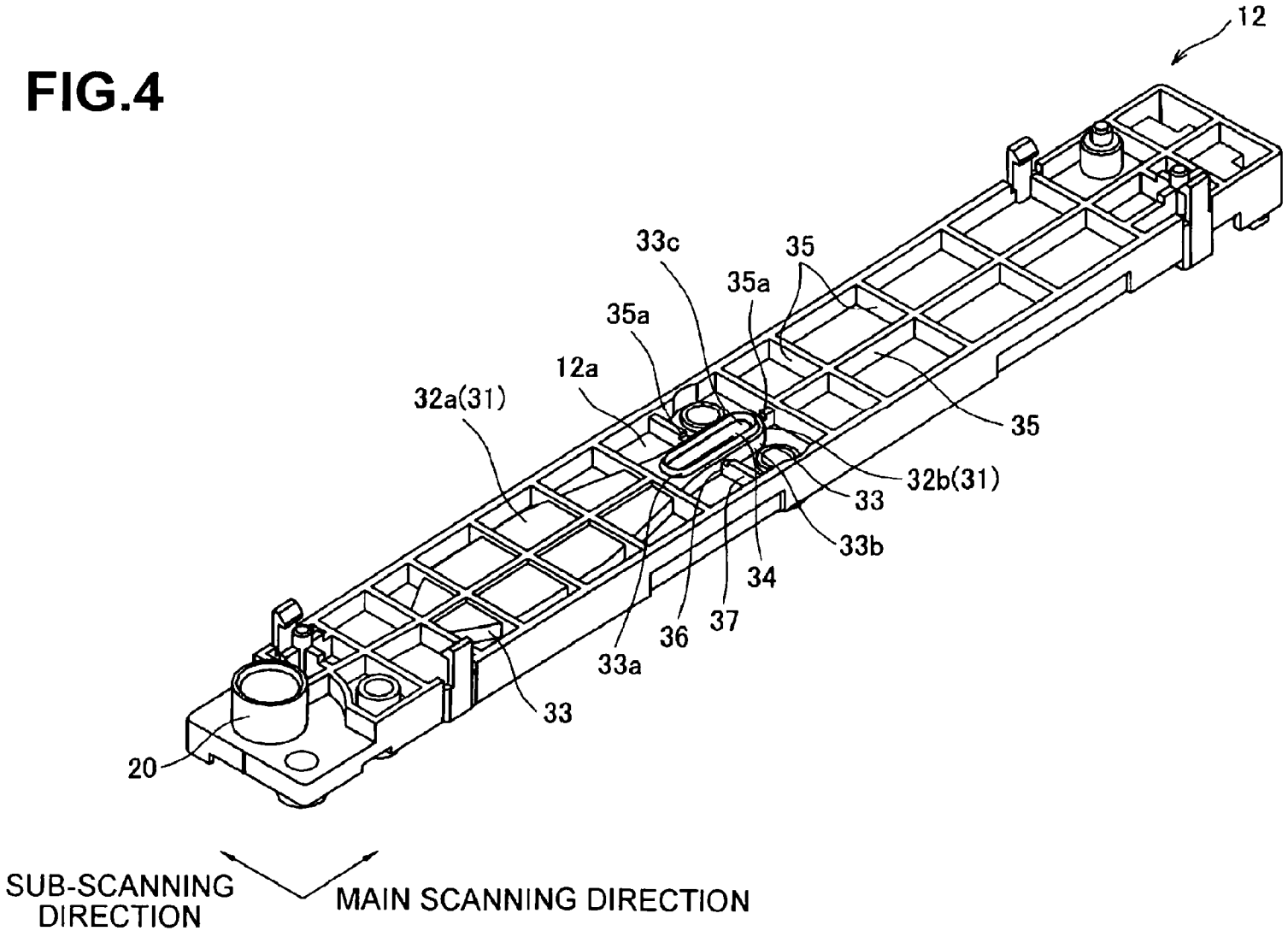
FIG. 4 is a perspective view of the main body of the upper reservoir block in FIG. 2, when viewed from above.

Referring to FIGS. 3A and 4, the protuberance 31, when viewed in a plan view, may have a wide portion 32*a*, which may be substantially oval shaped, and a narrow portion 32*b*. The width, e.g., the portion extending in the sub-scanning direction, of the wide portion 32*a*, may spread close to both ends of the main body 12, in the widthwise direction of the main body 12. The narrow portion 32*b* may be located in the vicinity of one end of the protuberance 31, facing the outlet port 22. The width of the narrow portion 32*b* may be narrower than that of the wide portion 32*a*.

In the protuberance 31, the narrow portion 32*b* may have a passage opening 34, which may extend in a first direction perpendicular to the upper reference surface 12*a*, and which may be elongated in the main scanning direction. The edge of the side wall 33, which may extend perpendicular to the upper reference surface 12*a* of the protuberance 31, may partially define the passage opening 34. Referring back to FIG. 2, the passage opening 34 may be closed by the film 13. In other words, the space surrounded by the film 13 and the inner surface 33*c* of the loop side wall 33 may serve as part of the upper reservoir passage 25.

The protuberance 31 may allow the depth, e.g., the height in the vertical direction in FIG. 2, of the upper reservoir passage 25 to be increased, in a portion between the vicinity of the outlet port 22 and the vicinity of the center of the upper reservoir passage 25, in the lengthwise direction thereof. A filter 10 may be positioned in such a deep portion, perpendicularly to the vertical direction in FIG. 2. Ink, which may be supplied from the inlet port 21 into the upper reservoir passage 25, may flow upward in the deep portion, while passing through the filter 10, and then may flow out of the outlet port 22.

Figure 3B:
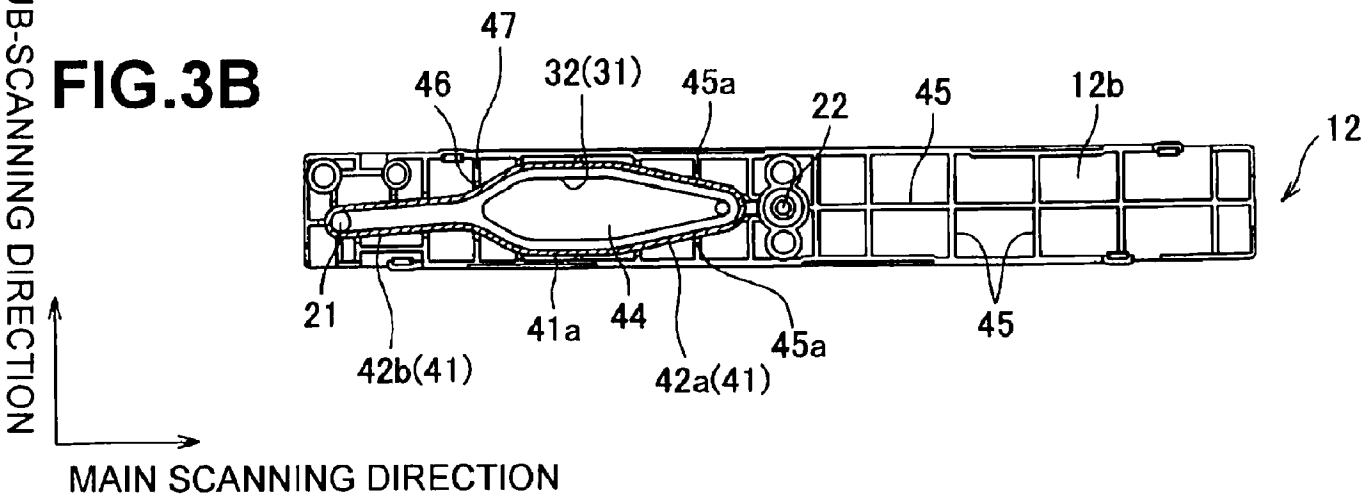
FIG. 3B is a bottom view of the main body shown in FIG. 3A.
Figure 5:
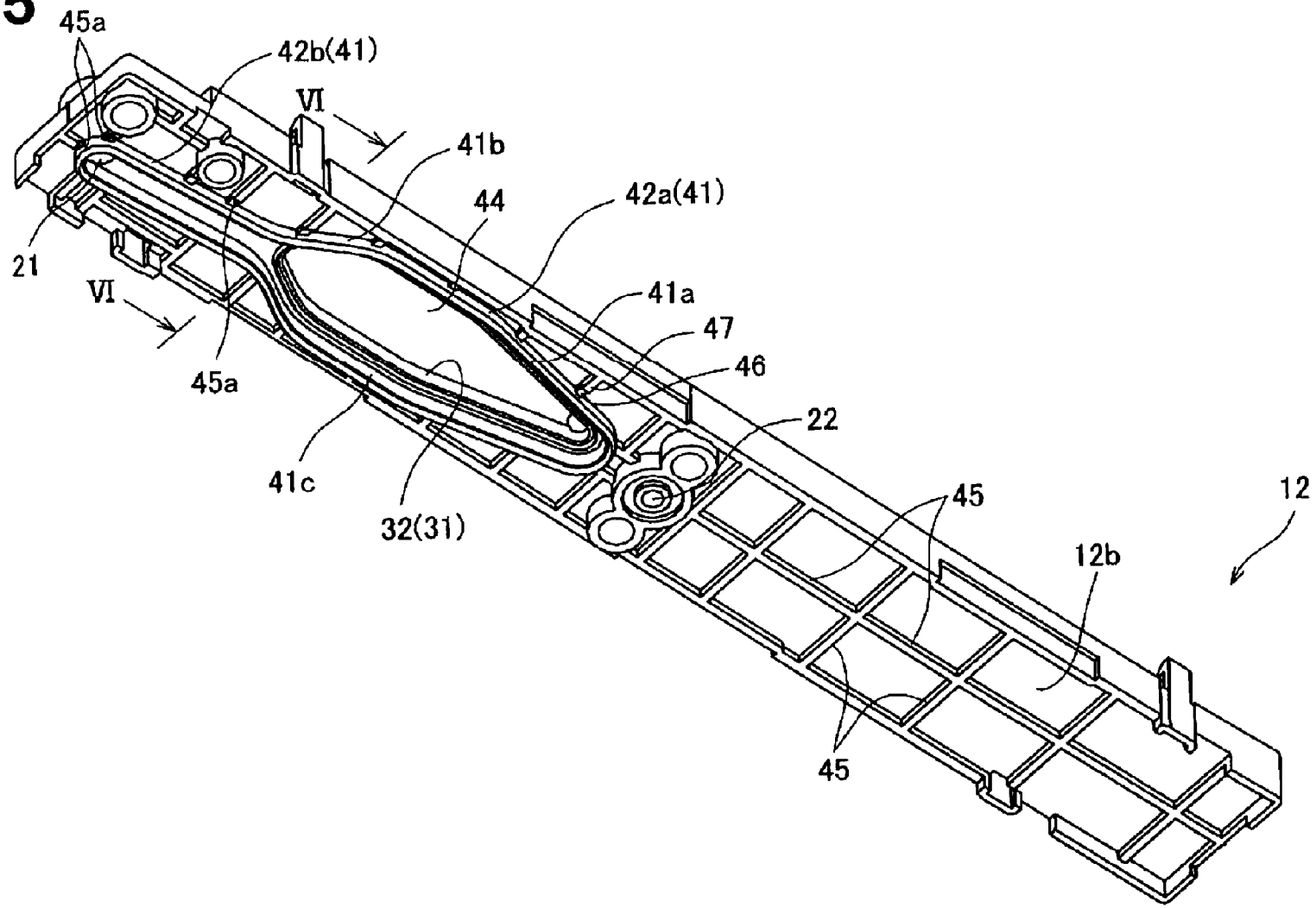
FIG. 5 is a perspective view of the main body of the upper reservoir block in FIG. 2, when viewed from below.

Part of the main body 12 may constitute a loop projection 41. Loop projection 41 may project downward from a lower reference surface 12*b*. Specifically, the loop projection 41 may surround a region extending from the inlet port 21 of the upper reservoir passage 25 to the vicinity of the outlet port 22. Referring now to FIGS. 3B and 5, the loop projection 41, when viewed in a plan view, may have a substantially oval-shaped wide portion 42*a*, and a narrow portion 42*b*. An area of wide portion 42*a* may be larger than an area of wide portion 32*a* of the protuberance 31 on the opposite side. The narrow portion 42*b* may extend from a first end of the loop projection 41 facing the inlet port 21 to one end of the wide portion 42*a* adjacent to the first end of the loop projection 41. The width of the narrow portion 42*b* may be narrower than the width of the wide portion 42*a*. The edge of the loop projection 41 may define a passage opening 44, which may extend in the first direction, perpendicular to the lower reference surface 12*b*. Referring back to FIG. 2, the passage opening 44 may be closed by the film 14. In other words, the space formed by the film 14 and the inner surface 41*c* of the loop projection 41 may serve as part of the upper reservoir passage 25.

Referring again to FIGS. 3A to 5, each of which show a state in which the films 13 and 14 may be not arranged, the upper end of the protuberance 31 surrounding the passage opening 34 may be tapered to provide a tapered portion 33*a*. The downward projecting end of the loop projection 41 surrounding the passage opening 44 may be tapered to form a tapered portion 41*a*. The tapered portions 33*a* and 41*a* may be configured to be melted when the films 13 and 14, for closing the passage openings 34 and 44, are welded to the main body 12. Referring to FIG. 3A, a portion of main body 12, e.g., the portion surrounding passage opening 34, may be configured to be welded to the film 13. Referring to FIG. 3B, a portion of main body 12, e.g., the portion surrounding passage opening 44, which is a hatched portion of FIG. 3B, may be configured to be welded to the film 14. In this manner, the passage openings 34 and 44 may be closed by the films 13 and 14, respectively.

Figure 6A:
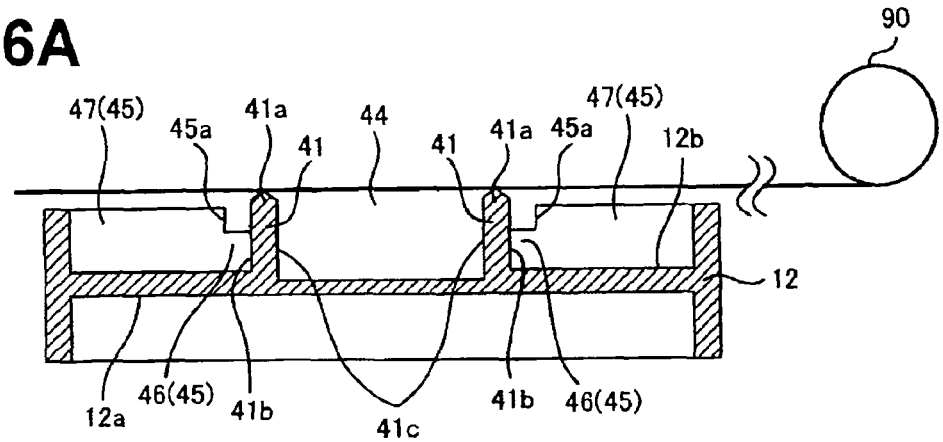
FIGS. 6A to 6C are diagrams illustrating a procedure for welding a filter shown in FIG. 2 to the main body, according to an embodiment of the invention.
Figure 6B:
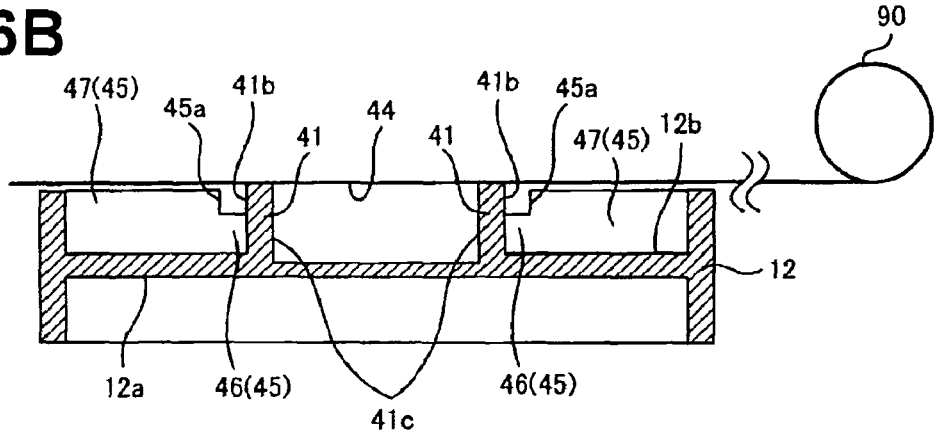

Referring to FIG. 6A, a rolled film 90 may be unrolled, and may be pressed against the tapered portion 41*a*, thus covering the passage opening 44 with the film 90. Subsequently, the tapered portion 41*a* may be melted by heating through the film 90. Referring to FIG. 6B, the film 90 may be welded to the loop projection 41. After that, the film 90 may be cut along the outer surface 41*b* of the loop projection 41 using a cutting tool, e.g., a cutter or a laser beam, to remove the excess film 90. Consequently, referring to FIG. 6C, the passage opening 44 may be covered with the film 14. 6C. Film 13 may be welded according to a similar procedure, thus an explanation of the procedure for welding film 13 is omitted.

The films 13 and 14 each may comprise a flexible material having a gas barrier property, e.g., a polyethylene terephtharate (PET) film with a vapor-deposited silica (SiOx) or aluminum layer. Accordingly, a gas outside the ink jet head 1 may be substantially prevented from entering the upper reservoir passage 25 in the upper reservoir block 11 through the films 13 and 14.

As described above, the flexible films 13 and 14 may define portions of the upper reservoir passage 25. Accordingly, films 13 and 14 may absorb abrupt variations in pressure exerted on ink in the upper reservoir passage 25, by deforming in response to the abrupt variations in pressure exerted on the ink. In other words, the films 13 and 14 each may function as a damper. Consequently, ink may flow smoothly in the upper reservoir passage 25, and the ink ejecting property may be stabilized. Referring back to FIG. 2, the film 14 may be positioned at a slight distance from the upper surface of the lower reservoir block 15, or the plate 16, so as not to impair the damper function of film 14.

The upper reference surface 12*a* may be provided with a plurality of ribs 35, which may upwardly project perpendicular to the upper reference surface 12*a*, and may extend in the main scanning and sub-scanning directions. In other words, the ribs 35 may be arranged substantially in a lattice. The lower reference surface 12*b* similarly may be provided with a plurality of ribs 45 arranged substantially in a lattice, the ribs 45 downwardly projecting perpendicular to the lower reference surface 12*b*. The arrangement of the ribs 35 and 45 may increase the solidity of the upper reservoir block 11, which may prevent the upper reservoir block 11 from deforming.

Figure 6C:
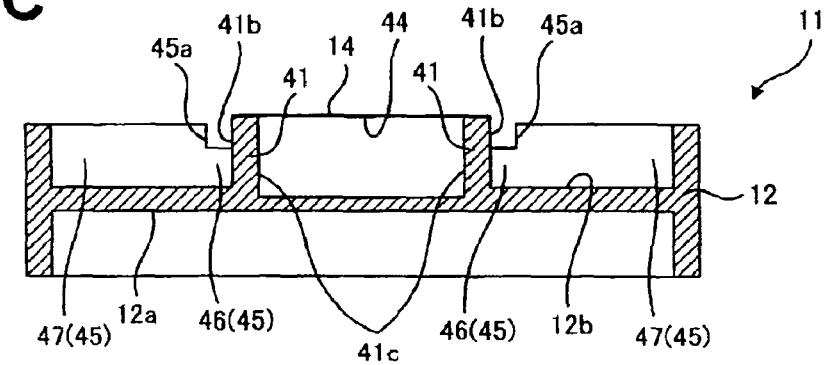

Referring back to FIGS. 6A to 6C, the level of each rib 45, relative to the lower reference surface 12*b*, hereinafter, interchangeably referred to as "the level of each rib 45" may be slightly lower than the level of the loop projection 41, relative to the lower reference surface 12*b*, hereinafter, interchangeably referred to as "the level of the loop projection 41", after completion of melting the tapered portion 41*a*. Each of the ribs 45 connected to the outer surface 41*b* of the loop projection 41, hereinafter interchangeably referred to as the specific notched ribs, may have a notch 45*a* in its upper end, and may be positioned such that the notch 45*a* is next to the outer surface 41*b*. Rib 45 may be divided into a first segment 46 and a second segment 47 in its extending direction, e.g., the sub-scanning direction as shown in FIGS. 6A to 6C, such that the first segment 46 may connect to the outer surface 41*b* of the loop projection 41. Notch 45*a* and the second segment 47 may be positioned on the opposite side of the first segment 46 relative to the loop projection 41. Further, the level of the first segment 46 of the rib 45 may be lower than the level of the loop projection 41. In other words, the rib 45 may be separated from the end of the loop projection 41. In addition, the level of the second segment 47 of the rib 45 may be higher than that of the first segment 46.

Referring again to FIGS. 3A and 4, the ribs 35 may be coupled to the side wall 33 of the protuberance 31, and each rib 35 may have a similar notch 35*a*. Specifically, the notch 35*a*, in each of the ribs 35, may be arranged in a first segment 36, which may connect to the external surface 33*b*. External surface 33*b* may be a portion of the side wall 33 of the protuberance 31, e.g., the portion defining the passage opening 34. Consequently, each rib 35 may be separated from the end of the side wall 33 of the protuberance 31. A second segment 37 may be disposed on the opposite side of the first segment 36 relative to the side wall 33. In addition, the level of a second segment 37 of the rib 35, relative to the upper reference surface 12*a*, may be higher than that of the first segment 36. The level of the rib 35 relative to the upper reference surface 12*a* hereinafter may be interchangeably referred to as "the level of the rib 35."

Referring again to FIG. 2, among the plates 16 to 18, the upper plate 16 may have a through hole located substantially at the center thereof, which may serve as a downward passage 16*a*. Downward passage 16*a* may be in fluid communication with the upper reservoir passage 25, via the outlet port 22. The lower plate 18 may have a plurality of, e.g., ten, through holes, which may serve as supply passages 18*a*. Referring to FIG. 7, supply passages 18*a* may be in fluid communication with respective ink supply ports 9, which may be arranged in the passage unit 5. Referring back to FIG. 2, the intermediate plate 17 may have a hole, which may serve as a reservoir 17*a*. Reservoir 17*a* may be in fluid communication with the downward passage 16*a* and the plurality of supply passages 18*a*. The downward passage 16*a*, the reservoir 17*a*, and the supply passages 18*a* may constitute a lower reservoir passage 27.

As indicated by the solid arrows in FIG. 2, which indicate the flow of ink in the reservoir unit 3, ink supplied from the inlet port 21 into the upper reservoir passage 25 may flow downward, and then may flow in the main scanning direction. At that time, the ink flowing in the main scanning direction may travel upward while passing through the filter 10, and again may flow downward in the center of the upper reservoir block 11. Ink flowing in the main scanning direction then may flow outward from the outlet port 22 into the downward passage 16*a* constituting the lower reservoir passage 27. In the lower reservoir passage 27, the ink may flow from the outlet port 22 of the upper reservoir passage 25 into the reservoir 17*a* via the downward passage 16*a*. In the reservoir 17*a*, the ink may reach the respective supply passages 18*a*. Referring now to FIG. 7, once ink reaches the respective supply passages 18*a*, ink may be supplied to the passage unit 5 via the respective ink supply ports 9.

As described above, the reservoir unit 3 may have a series of ink passages, such as the upper reservoir passage 25 and the lower reservoir passage 27. These ink passages may function as an ink reservoir for temporarily storing ink.

Figure 8:
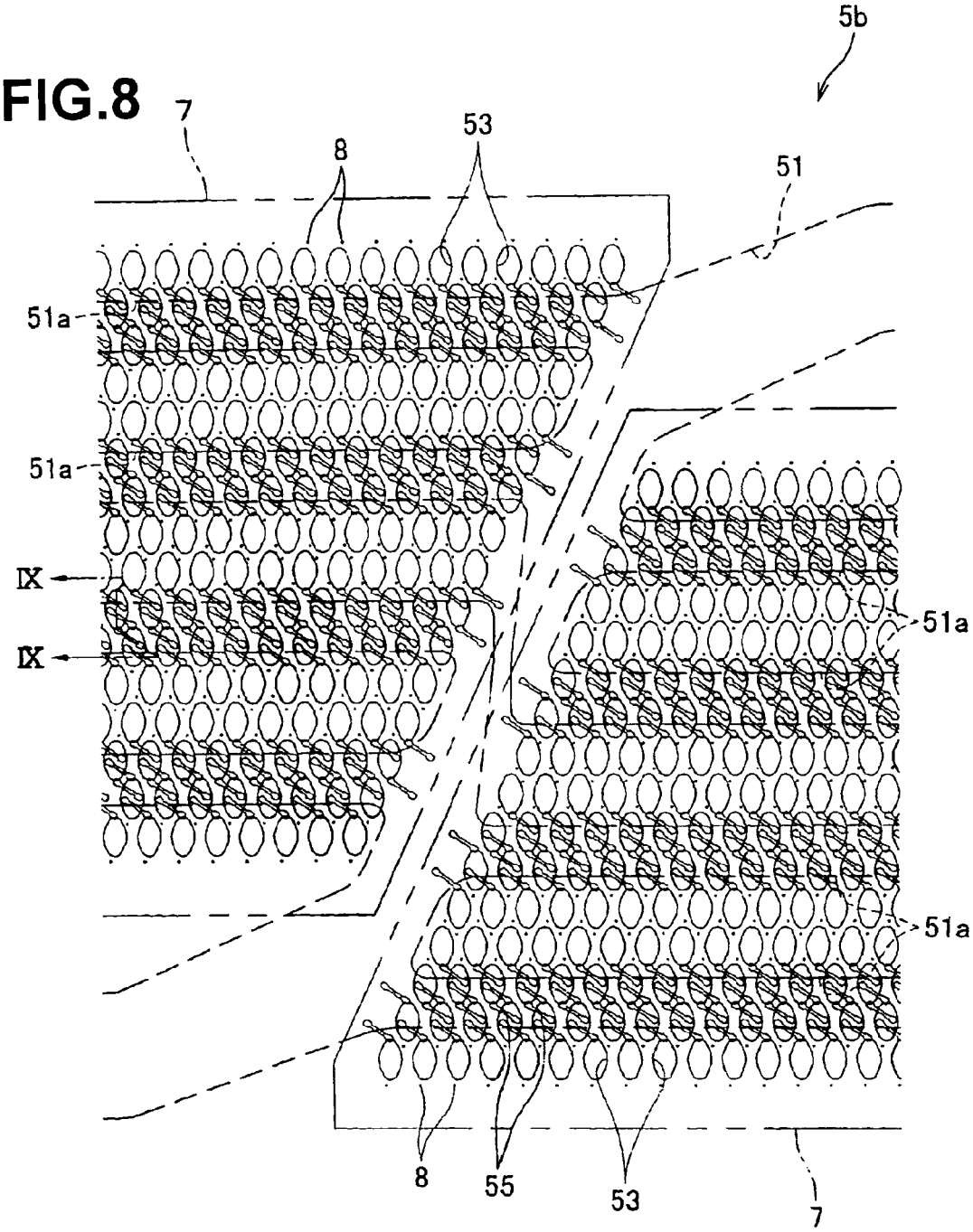
FIG. 8 is an enlarged view of part surrounded by an alternate long and short dash line in FIG. 7.

In FIG. 8, pressure chambers 53, apertures 55, and the nozzles 8 should be drawn using dashed lines because they are located under the actuator units 7. Nevertheless, in FIG. 8, the pressure chambers 53, the apertures 55, and the nozzles 8 are drawn using solid lines to facilitate understanding of the drawings.

Referring to FIG. 8, the passage unit 5 may be a rectangular solid having substantially the same planar shape as that of the plate 18 in the reservoir unit 3. The four actuator units 7 may have a trapezoidal planar shape, and may be arranged on the upper surface 5*a* facing the reservoir unit 3.

The upper surface 5*a* of the passage unit 5 may contain the plurality of ink supply ports 9. Referring back to FIG. 2, the plurality of ink supply ports 9 correspond to the respective supply passages 18*a* of the reservoir unit 3. Referring again to FIG. 9, the passage unit 5 may have manifold passages 51 in fluid communication with the ink supply ports 9, and sub-manifold passages 51 a branching off from the manifold passages 51. In the lower surface of the passage unit 5, ink ejecting areas 5*b* may be arranged opposite to the respective actuator units 7, with the passage unit 5 therebetween. Referring to FIG. 8, the plurality of nozzles 8 may be arranged in each ink ejecting area 5*b* in a matrix pattern. Referring again to FIG. 9, in the upper surface 5*a* of the passage unit 5, the many pressure chambers 53 may be arranged in a matrix pattern in each of areas facing the respective actuator units 7.

In an embodiment of the invention, as shown in FIG. 8, a plurality of, e.g., sixteen, rows of the pressure chambers 53 may be substantially equally spaced in the lengthwise direction, e.g., the horizontal direction as shown in FIG. 8, or the main scanning direction, of the passage unit 5 may be arranged in parallel in the widthwise direction, e.g., the vertical direction in FIG. 8, or the sub-scanning direction, of the passage unit 5 in each of areas facing the respective actuator units 7. The pressure chambers 53 may be disposed in each of the areas such that the number of pressure chambers 53 in each row may gradually decrease, and each row may correspond to the trapezoidal shape of the actuator unit 7, e.g., as the rows become closer to the shorter side of the trapezoid. The adjacent actuator units 7 may be equally spaced, such that the opposed sides of the actuator units 7 may be parallel to each other and the actuator units 7 are staggered. In aligning parts of the adjacent actuator units 7, the pressure chambers 53 may be arranged in complementary relationship, with respect to the lateral direction in FIG. 8.

Referring to FIG. 9, the passage unit 5 may include a plurality of, e.g., nine, plates made of metal, e.g., stainless steel. Specifically, the passage unit 5 includes, in order from the top, a cavity plate 61, a base plate 62, an aperture plate 63, a supply plate 64, manifold plates 65, 66, and 67, a cover plate 68, and a nozzle plate 69. Plates 61 to 69 each may have a rectangular planar surface in which the longer sides of the rectangular planar surface extend in the main scanning direction.

The cavity plate 61 may have a plurality of substantially rhomboid-shaped through holes, which may correspond to the respective pressure chambers 53. The aperture plate 63 may include the apertures 55, which may be in fluid communication with the respective pressure chambers 53 via connecting holes formed in the base plate 62. The manifold plates 65, 66, and 67 may have one or more through holes, which may be coupled to each other. The through holes in manifold plates 65, 66, and 67 may provide the manifold passages 51 and the sub-manifold passages 51*a* when the manifold plates 65, 66, and 67 are laminated. The sub-manifold passages 51*a* may be in fluid communication with the respective apertures 55 via connecting holes formed in the supply plate 64. The nozzle plate 69 may have one or more holes corresponding to the respective nozzles 8 for the pressure chambers 53. The plates 61 to 64 may have connecting holes (not shown) for connecting the ink supply ports 9 with the manifold passages 51. Furthermore, the plates 62 to 68 may have connecting holes for connecting the pressure chambers 53 with the nozzles 8.

These plates 61 to 69 may be laminated while being aligned with respect to each other, such that the manifold passages 51, the sub-manifold passages 51*a*, and the many individual ink passages 60 may be formed to extend from the outlets of the sub-manifold passages 51*a* to the respective nozzles 8 through the apertures 55 and the pressure chambers 53. Consequently, ink supplied from the reservoir unit 3 into the passage unit 5 via the ink supply ports 9 may flow into the manifold passages 51, and further may flow into the sub-manifold passages 51*a* branching off from the manifold passages 51. The supplied ink further may flow into the individual ink passages 60, such that the ink reaches the respective nozzles 8.

Referring to FIG. 7, the plurality of actuator units 7 may have a trapezoidal planar shape, and may be staggered such that the actuator units 7 may avoid the ink supply ports 9 in the upper surface 5*a* of the passage unit 5. The longer sides of the respective trapezoidal planar-shaped actuator units 7 may be arranged along the lengthwise direction of the passage unit 5, such that the long sides of two actuator units 7, which sandwich another one actuator unit 7, may be flush with each other.

Figure 10A:
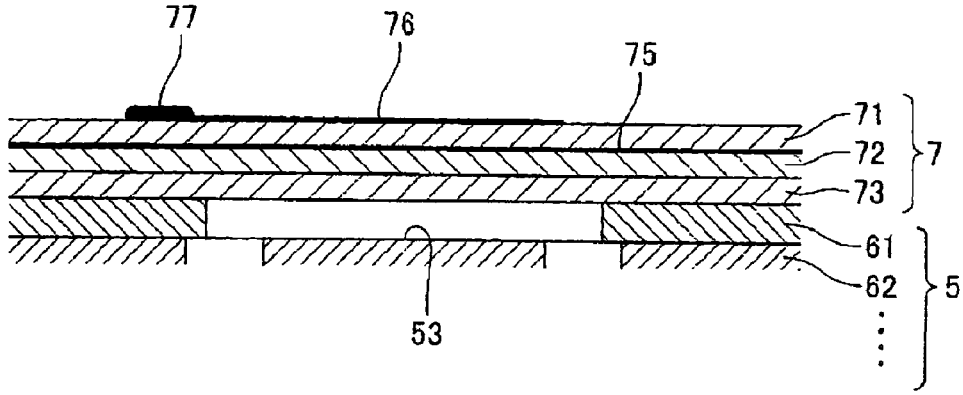
FIG. 10A is an enlarged cross-sectional view of an actuator unit shown in FIG. 9.

Referring to FIG. 10A, the actuator units 7 each may include a plurality of, e.g., three piezoelectric sheets 71, 72, and 73 made of a ferroelectric ceramic material, e.g., titanate zirconate (PZT). The piezoelectric sheets 71, 72, and 73 each may have a thickness of approximately 15 μm. The piezoelectric sheets 71, 72, and 73 may be disposed over the many pressure chambers 53 arranged for each ink ejecting area 5*b*.

The individual electrode 76 may be arranged on the upper piezoelectric sheet 71, and may correspond to each pressure chamber 53. A common electrode 75 may be interposed between the upper piezoelectric sheet 71 and the underlying piezoelectric sheet 72, and may be configured to cover the entire surface of each sheet. The common electrode 75 may have a thickness of approximately 2 μm, and may be held substantially at ground potential. The individual electrodes 76 and the common electrode 75 may be made of a metallic material, e.g., Ag—Pd. Piezoelectric sheets 72 and 73 may have no electrodes arranged between them.

Figure 10B:
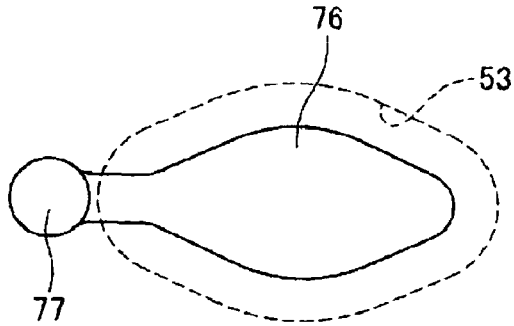
FIG. 10B is a plan view of an individual electrode arranged on one surface of the actuator unit in FIG. 10A.

Each individual electrode 76 may have a thickness of approximately 1 μm. Referring to FIG. 10B, the individual electrode 76 may have a substantially rhomboid planar shape, similar to the shape of the pressure chamber 53. One of the acute portions of the substantially rhomboid individual electrode 76 may be extended. The extended portion of individual electrode 76 may be provided with a circular land 77, which may have a diameter of approximately 160 μm, and which may be electrically connected to the individual electrode 76. The land 77 may be made of a gold containing, e.g., glass frit. Referring to FIG. 1, the respective lands 77 may be connected to the driver ICs 6*a* through the FPCs 6. Consequently, the potentials of the individual electrodes 76 may be selectively controlled.

To drive the actuator units 7, according to an embodiment of the invention, first, the piezoelectric sheet 71 may be polarized in the thickness direction. Accordingly, when the individual electrode 76 and the common electrode 75 are set to different potentials, and an electric field is applied to part of the upper piezoelectric sheet 71 between the individual electrode 76 and the common electrode 75 in the polarization direction, the electric-field-applied portion may function as an active portion that may deform due to a piezoelectric effect. The other two piezoelectric sheets 72 and 73 each may serve as an inactive layer having no region sandwiched between the individual electrode 76 and the common electrode 75. Accordingly, the sheets 72 and 73 may not voluntarily deform. In other words, each actuator unit 7 may be a unimorph type, consisting of a layer containing active portions and an inactive layer.

Referring to FIG. 10A, the piezoelectric sheets 71 to 73 may be fixed to the upper surface of the cavity plate 61 including the pressure chambers 53. Accordingly, when the deformation of the portion of the upper piezoelectric sheet 71 in which an electric field has been applied, differs from that of the underlying parts of the piezoelectric sheets 72 and 73 relative to the direction along the surfaces of the sheets thereto, all of the piezoelectric sheets 71 to 73 may deform toward the pressure chamber 53, e.g., unimorph deformation may occur. At that time, the capacity of the pressure chamber 53 may decrease, such that the pressure in the pressure chamber 53 then may rise. Consequently, ink may be squeezed out of the pressure chamber 53, to the corresponding nozzle 8, which may cause ink droplets to be ejected from the nozzle 8. After that, when the individual electrode 76 is set to the same potential as that of the common electrode 75, the piezoelectric sheets 71 to 73 may return to their original states, e.g., their flattened states, such that the capacity of the pressure chamber 53 may return to its original capacity. Thus, the ink may be introduced from the manifold passage 51 to the pressure chamber 53, such that the ink may be stored in the pressure chamber 53.

In the manufacture of the upper reservoir block 11, when the excess film 90 may be cut off from the edge of the side wall 33 of the protuberance 31, and the excess film 90 may be cut off from the edge of the loop projection 41 using a cutter, there is no obstacle in each cutting path, because, as described above, the level of each rib 35 may be lower than that of the side wall 33 of the protuberance 31 and the level of each rib 45 may be lower than that of the loop projection 41, the ribs 35 may be separated from the the ends of the side wall 33, and the ribs 45 may be separated from the loop projection 41. Thus, the cutting operation can easily be performed. Furthermore, the occurrence of a cutting mistake caused by hitting the blade of the cutter against the ribs 35 or 45 may be prevented, which may increase the manufacturing yield.

When the excess film 90 is cut off using a laser beam, the excess film 90 may be prevented from being welded to the ribs 35 or 45. Consequently, the step of removing the film 90 welded to the ribs 35 or 45 may be eliminated, which may improve efficiency of the cutting operation.

In the ink jet head 1 according to the present embodiment, some of the ribs 35 may be connected to the external surface 33*b* of the side wall 33 of the protuberance 31. Some of the ribs 45 may be connected to the outer surface 41*b* of the loop projection 41. Accordingly, the reinforcing effect by the ribs 35 and 45 may be increased.

As mentioned above, in each of the specific ribs 35, therefore, the level of parts which may be located in the cutting path for cutting the film 90 may be lowered below the level of the side wall 33 of the protuberance 31 extending from the upper reference surface 12*a*. Similarly, in each of the specific ribs 45, the level of parts which may be located in the cutting path may be lowered than that of the loop projection 41. In each of the specific ribs 35 and 45, the level of a part not located in the cutting path may be higher than that of a part in the cutting path. Consequently, the reinforcing effect by the ribs 35 and 45 may be further improved, and the film 90 may be cut efficiently. Thus, the solidity of the upper reservoir block 11 may be held sufficiently.

In the ink jet head 1 according to the present embodiment, the level of a portion in which the notch 35*a* is not arranged, of each specific rib 35 is at or below the level of the side wall 33 of the protuberance 31. Similarly, the level of a portion in which the notch 45*a* is not arranged, of each specific rib 45 is at or below the level of the loop projection 41. Therefore, during welding of the films 13 and 14 to the main body 12, if the unrolled film 90 is pressed against each of the side wall 33 and the loop projection 41 so as to cover the passage openings 34 and 44, the ribs 35 and 45 may not obstruct the operation. Furthermore, a tool that heats the films 13 and 14 for welding may not contact the ribs 35 and 45. Accordingly, the ribs 35 and 45 may not obstruct the operation of welding the films 13 and 14.

In the foregoing embodiment, the ribs 35 may be connected to the external surface 33*b* of the side wall 33 of the protuberance 31, and the ribs 45 may be connected to the outer surface 41*b* of the loop projection 41. Nevertheless, in another embodiment, it may be unnecessary to connect the ribs 35 to the external surface 33*b* of the side wall 33, and it also may be unnecessary to connect the ribs 45 to the outer surface 41*b* of the loop projection 41.

In the foregoing embodiment, the specific ribs 35 and 45 may have the notch 35*a* and 45*a*, respectively. Nevertheless, in another embodiment, when the ribs 35 are not connected to the external surface 33*b* of the side wall 33 and the ribs 45 are not connected to the outer surface 41*b* of the loop projection 41, it may be unnecessary to form the notches 35*a* and 45*a*. The level of each of the ribs 35 and 45 may be made uniform.

Having described the preferred embodiment of the present invention, it should be understood that the invention is not limited to the above-described embodiment and various changes and modifications thereof may be made without departing from the sprit or scope of the invention as defined in the appended claims.

What is claimed is:

1. A passage composite comprising:

a main body comprising:

a particular surface;

a passage projection portion extending away from the particular surface and comprising a particular end, an edge opposite the particular end, and an opening formed therethrough; and at least one rib positioned outside the passage projection portion, and extending away from the particular surface, wherein at least a portion of the at least one rib is positioned a predetermined nonzero distance from the edge of the passage projection portion, wherein the at least one rib comprises a first segment and a second segment, wherein at least a portion of the passage projection portion extends further away from the particular surface than the first segment, the second segment extends further away from the particular surface than the first segment, and the first segment is positioned between the passage projection portion and the second segment.

2. The passage composite of claim 1, further comprising a film welded to the edge of the passage projection portion, and configured to close the opening formed in the passage projection portion.

3. The passage composite of claim 1, wherein the at least one rib is connected to the passage projection portion.

4. The passage composite of claim 1, wherein the second segment extends further away from the particular surface than the passage projection portion.

5. The passage composite of claim 4, wherein the passage projection portion is substantially oval-shaped.

6. The passage composite of claim 1, wherein the edge opposite the particular end is a substantially flat surface.

7. The passage composite of claim 1, wherein the passage projection portion tapers away from the particular surface.

8. The passage composite of claim 1, wherein the main body further comprises:

a further surface opposite the particular surface;

a connection projection portion extending away from the further surface, and comprising a further end, a further edge opposite the further end, and a further opening formed therethrough; and at least one connection rib positioned outside the connection projection portion, and extending away from the further surface, wherein at least a portion of the at least one connection rib is positioned a predetermined nonzero distance from the edge of the connection projection portion.

9. The passage composite of claim 8, further comprising a further film welded to the further edge of the connection projection portion, and configured to close the further opening formed in the connection projection portion.

10. The passage composite of claim 8, further comprising:

an inlet valve configured to be in fluid communication with the passage projection portion; and an outlet valve configured to be in fluid communication with the connection projection portion.

11. An ink jet head comprising a passage composite, the passage composite comprising:

a main body comprising:

a particular surface;

a passage projection portion extending away from the particular surface and comprising a particular end, an edge opposite the particular end, and an opening formed therethrough; and at least one rib positioned outside the passage projection portion, and extending away from the particular surface, wherein at least a portion of the at least one rib is positioned a predetermined nonzero distance from the edge of the passage projection portion, wherein the at least one rib comprises a first segment and a second segment, wherein at least a portion of the passage projection portion extends further away from the particular surface than the first segment, the second segment extends further away from the particular surface than the first segment, and the first segment is positioned between the passage projection portion and the second segment.

12. The ink jet head of claim 11, wherein the main body further comprises:

a further surface opposite the particular surface;

a connection projection portion extending away from the further surface, and comprising a further end, a further edge opposite the further end, and a further opening formed therethrough; and at least one connection rib positioned outside the connection projection portion, and extending away from the further surface, wherein at least a portion of the at least one connection rib is positioned a predetermined nonzero distance from the edge of the connection projection portion.

13. The ink jet head of claim 11, further comprising an inlet valve configured to be in fluid communication with the passage projection portion; and an outlet valve configured to be in fluid communication with the connection projection portion.

14. The ink jet head of claim 11, further comprising:

a substrate configured to receive electrical components;

a reservoir unit configured to receive and to supply ink;

at least one ink supply port configured to be in fluid communication with the lower reservoir;

a passage unit configured to receive ink from the at least one ink supply port; and at least one nozzle configured to eject ink supplied from the passage unit, wherein the inlet valve is configured to supply ink to the passage projection portion, the passage projection portion is configured to be in fluid communication with the connection projection portion, and the outlet valve is configured to supply ink to the lower reservoir.

15. A printer comprising:

an ink cartridge configured to supply ink; and an ink jet head comprising a passage composite, the passage composite comprising:

a main body comprising:

a particular surface;

a passage projection portion extending away from the particular surface and comprising a particular end, an edge opposite the particular end, and an opening formed therethrough; and at least one rib positioned outside the passage projection portion, and extending away from the particular surface, wherein at least a portion of the at least one rib is positioned a predetermined nonzero distance from the edge of the passage projection portion, wherein the at least one rib comprises a first segment and a second segment, wherein at least a portion of the passage projection portion extends further away from the particular surface than the first segment, the second segment extends further away from the particular surface than the first segment, and the first segment is positioned between the passage projection portion and the second segment.

* * * * *